United States Patent [19]

Tamai et al.

[11] 4,019,993

[45] Apr. 26, 1977

[54] MANUFACTURING PROCESS FOR LIQUID DEVELOPER

[75] Inventors: Yasuo Tamai; Sadao Osawa; Satoru Honjo, all of Asaka, Japan

[73] Assignee: Fuji Photo Film Co., Ltd., Minami-ashigara, Japan

[22] Filed: Oct. 20, 1971

[21] Appl. No.: 191,078

[30] Foreign Application Priority Data

Oct. 21, 1970 Japan ..... 45-92660

[52] U.S. Cl. ..... 252/62.1

[51] Int. Cl.[2] ..... G03G 9/00

[58] Field of Search ..... 252/62.1

[56] References Cited

UNITED STATES PATENTS

| | | | |
|---|---|---|---|
| 3,337,288 | 8/1967 | Horiguchi et al. | 8/4 |
| 3,467,642 | 9/1969 | Horiguchi et al. | 8/4 |
| 3,503,881 | 3/1970 | Shinohara et al. | 252/62.1 |
| 3,554,946 | 1/1971 | Okuno et al. | 252/62.1 |
| 3,623,986 | 11/1971 | Machida et al. | 252/62.1 |
| 3,629,117 | 12/1971 | Okuno | 252/62.1 |
| 3,657,130 | 4/1972 | Machida et al. | 252/62.1 |
| 3,671,646 | 6/1972 | Kurita et al. | 252/62.1 |

FOREIGN PATENTS OR APPLICATIONS

| | | | |
|---|---|---|---|
| 852,646 | 10/1960 | United Kingdom | 8/4 |

*Primary Examiner*—Jack P. Brammer

*Attorney, Agent, or Firm*—Gerald J. Ferguson, Jr.; Joseph J. Baker

[57] ABSTRACT

A manufacturing process for liquid developer intended for developing the electrostatic latent image characterized by polymerizing one or more kinds of addition-polymerizable monomers with a mixture containing pigment and polymerization initiator to thereby obtain a graft polymer of the monomers and the pigments and treating the resultant polymerized product with a polar solvent of 12 or higher in dielectric constant, and then dispersing the component of the resultant product insoluble in the solvent in the carrier liquid of the liquid developer with high electric resistance whereby (a) the electric resistance of the developer, (b) the uniformity of the charge of the toner in the developer, and (c) the length of charge stability are enhanced because of the treating step.

8 Claims, No Drawings

MANUFACTURING PROCESS FOR LIQUID DEVELOPER

This invention relates to an improved method of the manufacturing process for the liquid developer utilized in the liquid development of the electrostatic latent image.

The technique of developing the electrostatic latent image may be categorized roughly into a dry method and a wet method. The wet method employs a liquid developer composed of highly electric insulative liquid (hereinafter called "carrier") and finely-divided pigment particles (hereinafter called "toner") dispersed in.

The toner is deposited on the surface of an electrophotographic sensitive material or electrostatic recording sheet under electric attraction or repulsion caused by the electrostatic latent image thereon, thus transforming the latent image into visible image. Usually, the toner is mixed with resin which is soluble to carrier liquid followed by dispersion into the carrier liquid.

As another manufacturing process for the liquid developer, there is a method where the resin component is directly bonded chemically to the surface of the toner particles (hereinafter called "graft method").

The process to obtain the liquid developer by the graft method will be described more in detail. When a monomer easy to polymerize, such as acrylic ester, is made to react with pigment and a small quantity of an polymerization initiator in a solvent, such as benzene, a polymerized product in the form of a graft polymer of the monomer and the pigment results (hereinafter merely called "polymerized product"). By the dispersion of the polymerized product into the carrier liquid, the electrophotographic liquid developer can be obtained.

It has been found, however, that if the liquid developer thus produced is employed as it is, the charge of the toner cannot be accomplished stably, and an image of high optical density is difficult to obtain.

It is an object of the present invention to provide a manufacturing process for the liquid developer improved to overcome such shortcomings of the graft method. It is a further object to present a method to maintain the charge of the toner stable for a long period of time. A still further object is to provide a manufacturing method for the liquid developer that permits an image of high optical density to be obtained. More particularly, the present invention relates to a manufacturing process for the electrophotographic liquid developer characterized by dispersing the polymerized product obtained by polymerization using a monomer easy to addition polymerization pigment and a mixture containing polymerization initiator and treated with polar solvent, such as alcoholic solvent and/or ketone type solvent, into the carrier liquid high electric insulating.

The polymerized product (usually called "graft carbon") is a mixture composed of an independent polymer, a pigment-coupled polymer, and another chemical by product. The independent polymer exists closely mixed with the pigment which has been coupled to the polymer, and is known to serve as the keeper of the dispersed state of the pigment that has been coupled to the polymer. The inventor has found out that the treating the graft carbon with a polar solvent to separate it into a polar solvent soluble portion and a polar solvent insoluble portion and utilizing the polar solvent insoluble portion only as the material of the toner for the liquid developer, a developer having more favorable properties can be obtained.

A comparison between the liquid developer prepared without polar solvent treatment of the polymerized product and the liquid developer obtained upon the polar solvent treatment expressly indicates the merits of the process of the invention.

To be more specific, the liquid developer of the present invention has the following features:

(1) Electric resistance (electric resistance value shown by the liquid developer contained in a resistance measuring cell when a voltage is applied thereto and the current becomes constant) is high.

(2) The charge of the toner in the liquid developer is uniform.

(3) The charge of the toner is maintained stable for a long period of time. Therefore, the use of the liquid developer obtained by the process of the present invention provides an image of a remarkably high optical density. It is another feature of the liquid developer to provide a clear image with little fog.

The pigments employed in the process of the prevention include, to name some, carbon black, aniline black, phthalocyanine blue and phthalocyanine black, which equally offer satisfactory use.

As the addition-polymerizable monomer, vinyl type monomers, such as acrylic ester, methacrylate ester and styrene, may be used. Styrene, lower alkyl acrylate and lower alkyl-methancrylate, when added to the carrier liquid, however, tend to produce a polymerized product inferior in dispersion. As the monomers that provide the polymerized product excellent in dispersion, there are those disclosed by the U.S. Pat. No. 3,503,881 and Belgian Pat. No. 706,742 available. For example, alkylester methacrylate or acrylate with the carbon number in the alkyl group ranging from 6 to 18 provides the polymerized product that demonstrates excellent dispersion.

These monomers may be used individually or may be copolymerized with other vinyl monomers, such as a monomer containing amino group, carboxylic group and nitril group.

For example, carbon black graft-coupled with a copolymer if dimethylaminoethyl methacrylate or acrylic acid and lauryl acrylate brings about favorable results.

As representative polymerization initiators, N,N'-azobisisobutylnitrile, azobispropionitrile, azobisvaleronitrile, etc. are well known.

As the polar solvents used to treat the polymerized product obtained upon polymerization it has been found that water, alcoholic solvents including methanol, ethanol, butanol and propanol, and ketone type solvents including acetone, methylethyletone, diethylketone and methylisobutylketone are suitable.

Of course, solvents, those higher than 12 specific dielectric constant at the temperature of 20° C. are suitable for the process of the present invention. But those lower than 12 specific dielectric constant are not suitable, because it becomes difficult to separate only the polar substance from the polymerized product.

It is believed that the treatment with solvent having such relatively polar substances from the separate the relatively polar substances from the polymerized product.

It is the matter of course that the solvent used for the treatment must be in the liquid from at the room temperature and that it must not resolve or decompose the pigment. Such solvents can be used, independently or mixed. The preferable ones are methanol, ethanol, acetone and a mixture thereof.

The effect of the polar solvent depends on how often the treatment is made.

To take a polymerized product resulting from the reaction between Carbon Black and laurylacrylate for an example, is considered proper to treat it with ethanol at a ration of one part (weight part — hereinafter expressed by weight part) to 0.5 to 1000 parts twice up the five times. The solvent treatment is accomplished by adding the polymerized product to the solvent while being strongly stirred. Alternatively, the polymerized product resolved into saturated hydrocarbon or aromatic hydrocarbon may be added to the treating solvent. The pigment bonded to the polymerized product becomes insoluble in the treating solvent, so that it can be collected easily. In the case of the treatment using water or methanol, the polymerized product being treated is containing such solvent. As water or methanol is not miscible the carrier liquid, it is undesirable to add it to the carrier liquid. Thus, when the polymerized product is treated with water or methanol, it is desirable to finally use a treating solvent that can be miscible the carrier liquid — such as ethanol or acetone. The polymerized product thus treated with a solvent is added into the carrier liquid as it is or after dried to get rid of the solvent used. When the polymerized product is hard, it is made dispersed by a small amount of the carrier liquid or the aromatic solvent, and can be added to the polar solvent. As the carrier liquid, a highly insulative liquid, such as aliphatic hydrocarbon solvent, alicyclic hydrocarbon solvent, silicone, oil, or fluoro chloro hydrocarbon solvent is utilized. Preferably, these carrier liquids should have an electric resistance exceeding $10^{10}\Omega$cm.

In the liquid developer obtained by the process of the present invention, the toner have strong charge in carrier liquid.

In order to obtain a still clearer image, however, a small quantity of a charge controlling agent such as a fatty acid, metal salt of fatty acid may be employed.

To 1000 parts of the carrier liquid, the polymerized product that has been treated can be added in a quantity between 0.1 and 50 parts. By the process of the present invention, a liquid developer with a high toner content can be produced, which will not be deteriorated in properties (charge stability, dispersibility etc.). This suggests the suitability of the developer of the present invention to the reproduction of the continuous tone image. To improve the fixation of toner, it is desirable to add 0.3 – 80 parts of the resin soluble in the carrier liquid to 1000 parts of the carrier liquid. Now, some embodiments of the present invention will be described. In view of the fact that the persons skilled in this art should be well aware that the mixing ratio of necessary components, the manufacturing technique and so forth are changeable to such an extent as will not deviate from the intent of the present invention, it is to be noted that the invention should not be limited by the examples cited hereunder.

EXAMPLE 1.

The following components were mixed.

Lauryl methacrylate 19 parts
acrylic acid 1 part
Carbon black (made by furnace process) 15 parts
Azobisisobutylonitrile 0.3 parts
Benzene 10 parts Azobisisobutylonitrile is a polymerization initiator. The black mixture of these components was frozen in a glass flask for polymerization use. After completely degassed, the flask was sealed under reduced pressure and was heated up to 65° C. With the flask maintained at this temperature, the mixture was subjected to polymerization, producing a polymerized product in 6 hours.

Subsequent mixing of one part of this polymerized product with two parts of cyclohexene, resulted in a mixture, which was added into fifty parts of ethanol and mixture was rested to result in a precipitate of the black paste on the bottom of the container. The mother liquor was then a little opaque, inclining to dark. After this mother liquor was decanted, another fifty parts of ethanol was added to the black paste settled in the container, and the resultant mixture was strongly stirred. Subsequently, the black mass only was separated by the treatment repeated twice, the black mass was increased in viscosity. After the black mass was heated to get rid of ethanol, one part thereof was added into three hundred parts of kerosene to be dispersed therein. The dispersibility of toner is quite well. The toner in the liquid developer thus obtained continued to show a favorable charge throughout 50 days long aging test in the copying machine. In the meantime, the electrophotographic zinc oxide sensitive paper electrically charged to −⅝V was exposed to the light through the positive original, thereby giving rise to an image thereon. After the imageing by the exposure, the surface of the sensitive layer bearing the latent image was wetted with clean kerosene containing no toner once, and then was dipped in the aforementioned liquid developer. The liquid developer was accommodated in a metal container and by bringing the latent image surface close to the bottom of container the effect of the bottom acted for the development electrode. Following 30 seconds of development, the sensitive paper was taken out of the liquid developer, washed in toner-free Isopar E (Isoparaffinic solvent: trade name of Esso Standard Co.) dried. This resulted in a clear positive image. Optical density in produced image showed 0.09 at the lowest and 2.01 at the highest. Also, this liquid developer was placed in an electric resistance measuring cell, to which a voltage of 90V (DC) was applied. In seven minutes when the current became almost stabilized, the electric resistance showed$4.2 \times 10^{12}\Omega$ cm.

COMPARATIVE EXAMPLE

For the sake of comparison, one part of the polymerized product obtained in EXAMPLE 1 was added to three hundred parts of kerosene without being subjected to solvent treatment and was dispersed therein, to find that the dispersed condition of the toner was almost as good as that witnessed when the liquid developer obtained in Example 1 was used. This was followed by the developing operation in the same manner as described in Example, 1, resulting in an indistinct positive image. The fog density in the produced image showed 0.18 up to 1.42. The electric resistance of the liquid developer used was measured to find it was $2.6 \times 10^{11}\Omega$ cm.

EXAMPLE 2

Ten parts of graft carbon SLC-512 made by Nippon Gas Kagaku Co., Ltd. (the standard sample described in the specification as being a methacryl monomer graft-bonded to Carbon Black) was treated twice using one hundred parts of methanol each time. Upon this treatment, the polymerized product was dried at a temperature maintained at 80° C. under reduced pressure. Two parts of a resultant black mass in the pitch form was dispersed in 1000 parts of Isoper H (isoparaffinic solvent made by Esso Standard Co.) to obtain a liquid developer. By the use of this liquid developer, the sensitive layer bearing the latent image was developed to obtain a positive image of the original.

The catalog and other literature published by Nippon Gas Kagaku, Co. suggest the use of the graft carbon as the electrophotographic printing toner (which is presumed to include the developer). For the sake of comparison, however, SCL–512 was added to the carrier liquid without being subjected to solvent treatment, to find that the toner was dispersible, but the charge of toner was so obscure that nothing but a blurred indistinct image could be obtained.

EXAMPLE 3

Instead of ethanol used for the cleaning in Example 1, acetone was employed to obtain similar results.

EXAMPLE 4

Instead of ethanol used in Example 1, a solution of water and ethanol mixed at a mixing ratio of 10 : 90 was employed as the treating solvent. The black paste was treated with this mixed solution twice, and was further washed in acetone once. The black paste was then heated on a hot plate for 1 hour to dry any residual treating solvent. In the liquid developer obtained from the paste in the same manner as in Example 1, the toner had a positive electric charge, with which a satisfactory positive image could be produced by the developing technique used in Example 1.

EXAMPLE 5

To 100 parts of the liquid developer obtained in Example 1 was added 0.02 parts of cobalt naphthenate and the resultant mixture was stirred. Development in this developer by the same technique as in Example 1 provided an excellent positive image. The optical density was 0.08 (fog) up to 2.07 (maximum).

The manufacturing process for liquid developer of the present invention has been described. Having very excellent properties, the liquid developer obtained by the process of the invention offers ideal use for not only electrophotography but also the development of the electrostatic recording sheet.

What is claimed is:

1. A process for making a liquid developer intended for developing an electrostatic latent image, said process comprising the steps of (1) polymerizing one or more kinds of addition-polymerizable monomers with a mixture containing pigment and polymerization initiator to thereby obtain a graft polymer of said monomers and said pigments and treating the resultant polymerized product with a polar solvent of 12 or higher in dielectric constant, and then (2) dispersing the component of said resultant product insoluble in the said polar solvent in the carrier liquid of said liquid developer, said carrier liquid having high electric resistance and being selected from the group consisting of aliphatic hydrocarbon solvents, alicyclic hydrocarbon solvents, silicone, oil, and fluoro chloro hydrocarbon solvents whereby (a) the electric resistance of said developer, (b) the uniformity of the charge of the toner in the developer, and (c) the length of charge stability are enhanced because of said treating step.

2. A process as claimed in claim 1 wherein said solvent is water, alcohols or ketones.

3. A process as claimed in claim 2 wherein said alcohols are methanol, ethanol, propanol or butanol.

4. A process as claimed in claim 2 wherein said ketones are acetone, methyl ethyl ketone, diethyl ketone or methyl isobutyl ketone.

5. A process as claimed in claim 1 wherein said pigment is aniline black, phthalocyanine, blue, and phthalocyanine black.

6. A process as claimed in claim 1 wherein said pigment is carbon black.

7. A process as claimed in claim 1 wherein said monomer is acrylic ester or methacrylic ester.

8. A process as claimed in claim 1 wherein said carrier liquid has an electric resistance exceeding $10^{10}$ ohm cm.

* * * * *